US009383172B1

(12) United States Patent
Gamache et al.

(10) Patent No.: US 9,383,172 B1
(45) Date of Patent: Jul. 5, 2016

(54) INTERLEAVING ANGLED HEXAGONAL TILE FOR FLEXIBLE ARMOR

(71) Applicants: Raymond M. Gamache, Indian Head, MD (US); Justin T. Blair, Woodford, VA (US)

(72) Inventors: Raymond M. Gamache, Indian Head, MD (US); Justin T. Blair, Woodford, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 33 days.

(21) Appl. No.: 14/604,644

(22) Filed: Jan. 23, 2015

(51) Int. Cl.
*F41H 5/00* (2006.01)
*F41H 5/02* (2006.01)

(52) U.S. Cl.
CPC ..... *F41H 5/02* (2013.01)

(58) Field of Classification Search
CPC ... F41H 5/0492; F41H 5/0414; F41H 5/0428; F41H 1/02
USPC ..... 428/80; 89/36.02; 2/2.5
See application file for complete search history.

(56) References Cited

U.S. PATENT DOCUMENTS

| | | | | |
|---|---|---|---|---|
| 7,284,470 | B2 | 10/2007 | Huber et al. | 89/36.02 |
| 8,220,378 | B2 | 7/2012 | Gamache et al. | 89/36.02 |
| 2011/0203452 | A1 | 8/2011 | Kucherov et al. | 89/36.02 |
| 2012/0312150 | A1 | 12/2012 | Gamache et al. | 89/36.02 |

FOREIGN PATENT DOCUMENTS

| | | | |
|---|---|---|---|
| WO | WO 2011/142867 | 11/2011 | F41H 5/04 |

*Primary Examiner* — Alexander Thomas
(74) *Attorney, Agent, or Firm* — Gerhard W. Thielman, Esq.

(57) ABSTRACT

An interleaving hexagonal tile (AHT) is provided for incorporation onto a liner in an array for a personnel armor clothing article. The AHT includes a hexagonally-symmetric solid object composed of a homogeneous material. The object includes a geometry that has obverse and reverse planar surfaces parallel to each other. Each planar surface has triangularly disposed terminals. First and second triple sets of oblique surfaces are disposed between the obverse and reverse planar surfaces. A plurality of facets is disposed substantially perpendicular to the planar surfaces. The facets connect between edges of the planar surfaces and adjacent edges of the oblique surfaces. The first and second triple sets of oblique surfaces are disposed to alternate with each other.

9 Claims, 4 Drawing Sheets

INTERLEAVING ANGLED HEXAGONAL TILE FOR FLEXIBLE ARMOR

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to tiles for body armor. In particular, the invention relates to interlocking tiles to provide protection from small arms fire with improved flexibility.

During combat and insurgency patrol, military personnel can be subject to small-arms fire from gun-fired projectile rounds, as well as blast and fragmentation from grenades, designed to attack flesh. Personnel struck by such weapons can suffer serious or even mortal injury. To reduce vulnerability to combatants from such lethal contacts, wearable personnel armor, such as a vest with resistant-fiber mesh, has been developed. Further improvements have integrated high strength intermediary materials to further absorb or deflect kinetic impacts. Such measures have added weight and reduced flexibility for personnel so clad.

Conventional tactical body armor within the United States armed forces consists of small arms protective insert (SAPI) and Enhanced SAPI (ESAPI) ceramic trauma plates. The plates vary in performance where the SAPI plates are capable of defeating M80 ball rounds and the ESAPI is capable of defeating 0.30 caliber M2AP rounds. The plates are inserted within an interceptor vest which is capable of stopping 9 mm×19 mm handgun bullets. Conventional ESAPI/SAPI plates are comparatively large and bulky, and additionally limit flexibility of the wearer.

SUMMARY

Conventional body armor yield disadvantages addressed by various exemplary embodiments of the present invention. In particular, various exemplary embodiments provide an angled hexagonal tile (AHT) to incorporate as an interleaving arrayed plurality for a personnel armor clothing article. The plurality for the array is adhered onto a liner substrate. The AHT includes a hexagonally-symmetric solid object composed of a homogeneous material. The object includes a geometry that has obverse and reverse planar surfaces parallel to each other and separated by a thickness. Each planar surface has triangularly disposed terminals. Each obverse terminal is angularly offset to an adjacent reverse terminal.

In exemplary embodiments, the terminals on each corresponding planar surface have a length between a vertex at a first terminal and a center-point between second and third terminals. A first triple set of obverse-facing oblique surfaces is disposed between the obverse and reverse planar surfaces. Each obverse-facing oblique surface connects an obverse center-point on the obverse planar surface and a corresponding reverse terminal on the reverse planar surface. A second triple set of reverse-facing oblique surfaces is disposed between the obverse and reverse planar surfaces.

Each reverse-facing oblique surface connects an obverse terminal on the obverse planar surface and a corresponding reverse center-point on the reverse planar surface. A plurality of facets is disposed substantially perpendicular to the planar surfaces. The facets connect between edges of the planar surfaces and adjacent edges of the oblique surfaces. The first and second triple sets of oblique surfaces are disposed to alternate with each other.

In various embodiments, the object is composed of ceramic. In alternate embodiments, the planar surfaces form a contiguous triangular arrangement of hexagons. In other embodiments, these surfaces form a triangular boundary terminated by elongated octagons.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Exemplary embodiments provide an interlocking tile geometry that improves protection of a surface otherwise vulnerable to kinetic collision, such as from bullet impact. Such tiles can be arranged between substrate layers to provide contiguous yet flexible shock-absorbent material in a wearable clothing article, such as in a jacket to protect the wearer's torso. The layers can represent a variety of woven fabrics, such as aramid Kevlar® and high-modulus polyethylene Spectra®.

The tile design corresponds to a hexagonally symmetric form to represent an angled hexagonal tile (AHT) geometry. The AHTs provide three advantages including: (a) angled interfaces that reduce interstitial vulnerability from conventional tiles, (b) force distribution enhances multi-impact capability by reduced damage propagation, and (c) adhesion to one surface of the AHTs to a flexible fabric facilitates flexibility with an integrated and contiguous area of body protection from blunt force trauma.

Figure 1:
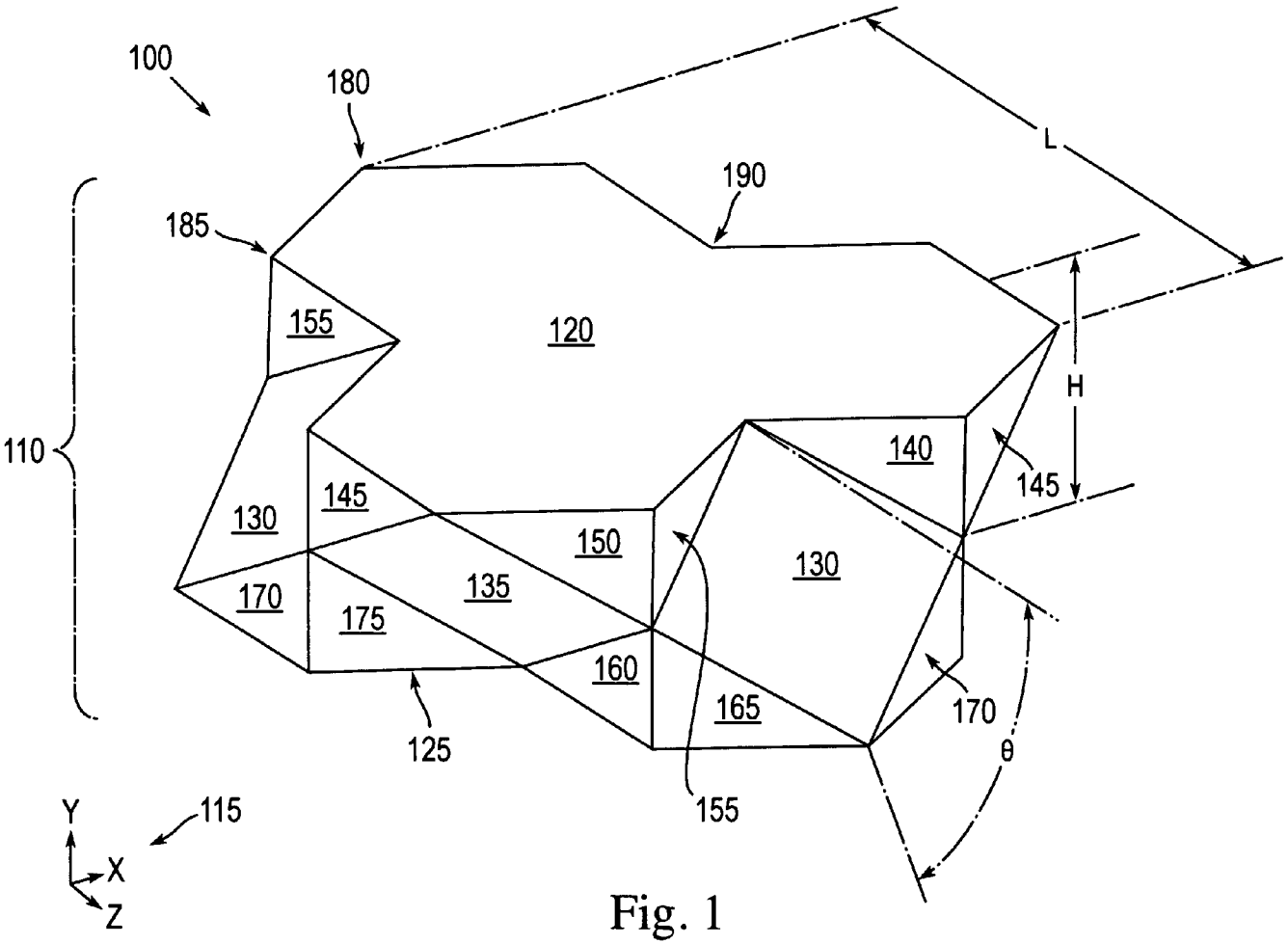
FIG. 1 is an isometric view of a first tile configuration.

FIG. 1 shows an isometric view 100 of a first tile configuration 110 for an AFT. A compass rose 115 shows Cartesian orientation of the first AHT 110 with x and z directions representing the facial x-z plane parallel to the surface to be shielded, and y direction denoting thickness. View 100 shows an obverse planar surface 120 (normal upward relative to y) parallel to a reverse planar surface 125 (normal downward relative to y). These planar surfaces 120 and 125 reveal a contiguous regular tri-hexagonal form.

Triple upward-facing oblique rectangular wedges 130 concatenate alternatingly with counterpart triple downward-facing oblique rectangular wedges 135. Obverse-adjacent triangular edge facets 140, 145, 150 and 155 interweave the wedges 130 and 135 with the obverse surface 120. Similarly, reverse-adjacent triangular edge facets 160, 165, 170 and 175 interweave the wedges 130 and 135 with the reverse surface 125. These triangular facets are substantially perpendicular to the planar surfaces 120 and 125 and thereby at least approximately parallel to y. The planar surfaces 120 and 125 feature three outward obtuse tips 180 flanked by six adjacent obtuse vertices 185, such that three inverse divots 190 are disposed therebetween. Effectively, tips 180 and the divots 190 yield overlapping triangles that form a Star-of-David on the planar surface 120.

Thickness of the tile 110 between the planar surfaces 120 and 125 is denoted as height H and for exemplary personnel armor can vary based on threat assessments. Expected thickness range between ¼ inch and ⅝ inch. The example height illustrated in view 100 constitutes 0.50 inch (1.27 cm). Distance along the obverse surface 120 between a first tip 180 and its opposite divot 190 on the obverse surface 120 is denoted as length L, which for exemplary personnel armor can vary between one inch and five inches, depending on requirements. The example length in view 100 measures 1.25 inch (3.175 cm).

The interface angle θ between the divot 190 on the obverse surface 120 and the adjacent tip 180 on the reverse surface 125 can vary from ten degrees to sixty degrees. The example angle in view 100 is 50.19442891° (0.87606 radian). The tips 180 on the obverse surface 120 and the tips 180 on the reverse surface 125 are angularly offset. In the configuration shown, this phase offset is 180° (π radians) between the corresponding obverse and reverse tips 180.

Figure 2:
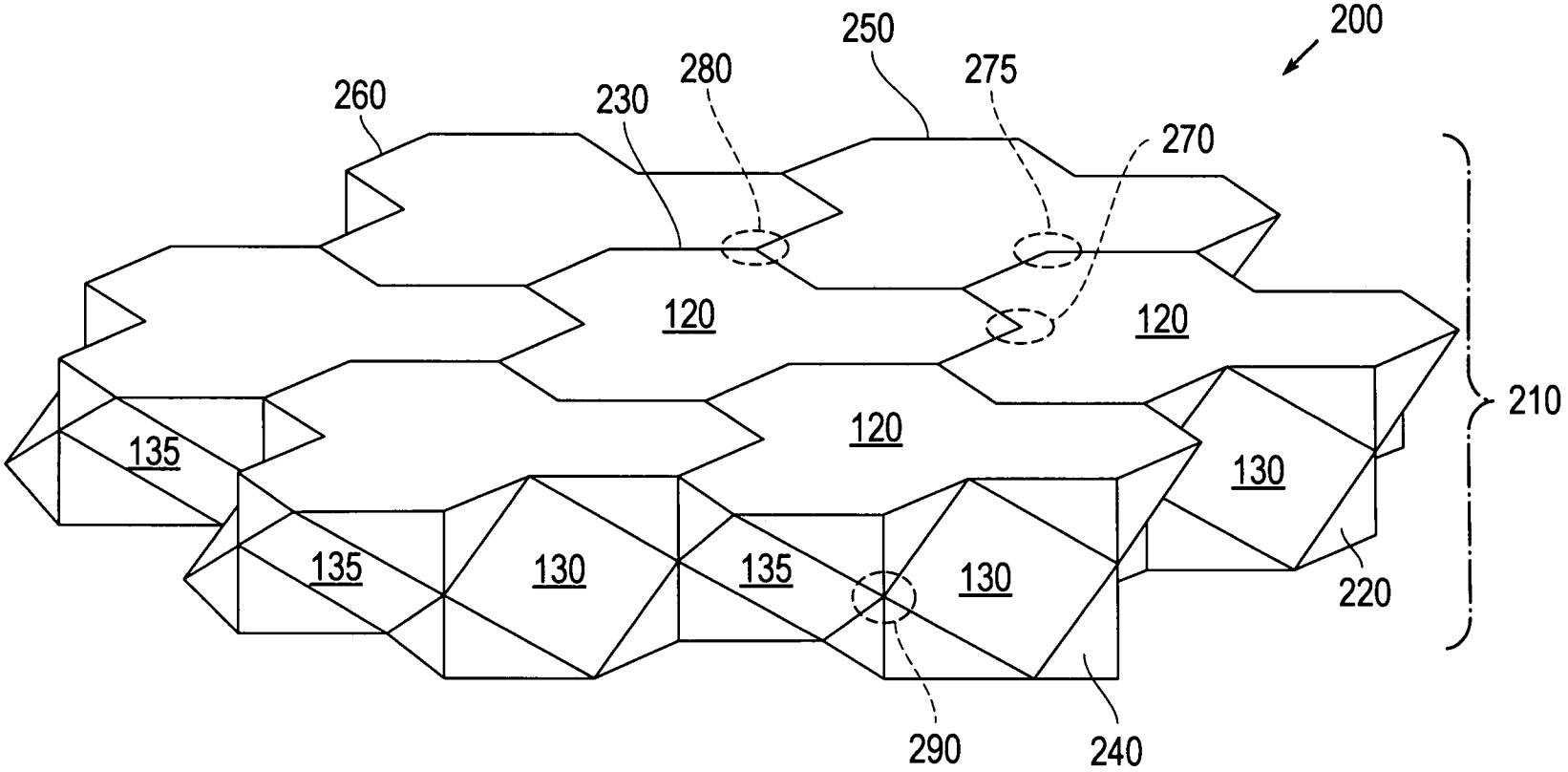
FIG. 2 is an isometric view of an array of first tiles.

FIG. 2 shows an isometric view 200 of an array 210 of the first AHTs 110 connected together by interleaving facets. The obverse surfaces 120 and select wedges 130 and 135 along the edge are illustrated. Of the seven tiles 110 depicted, the fore unit 220 presents one tip 180 facing right, with aft unit 230, starboard unit 240 and port unit 250 sharing edges, along with a rear unit 260 behind the port unit 250. Edge transitions along the obverse surfaces 120 include corners at tip-to-divot 270, vertex-to-divot 275, and vertices junction 280. Fore and aft units 220 and 230 connect with the tip-to-divot 270.

Fore and port units 220 and 250 connect with the tip-to-divot 275. At their adjacent vertices 185, the port, aft and rear units 230, 250 and 260 connect together at their common junction 280. Similarly, complementary wedges 130 and 135 on adjacent tiles 110 face each other, as do triangular facets 140 with complements 150, along with facets 145 with 155, facets 160 with 170 and facets 165 with 175.

Figure 3:
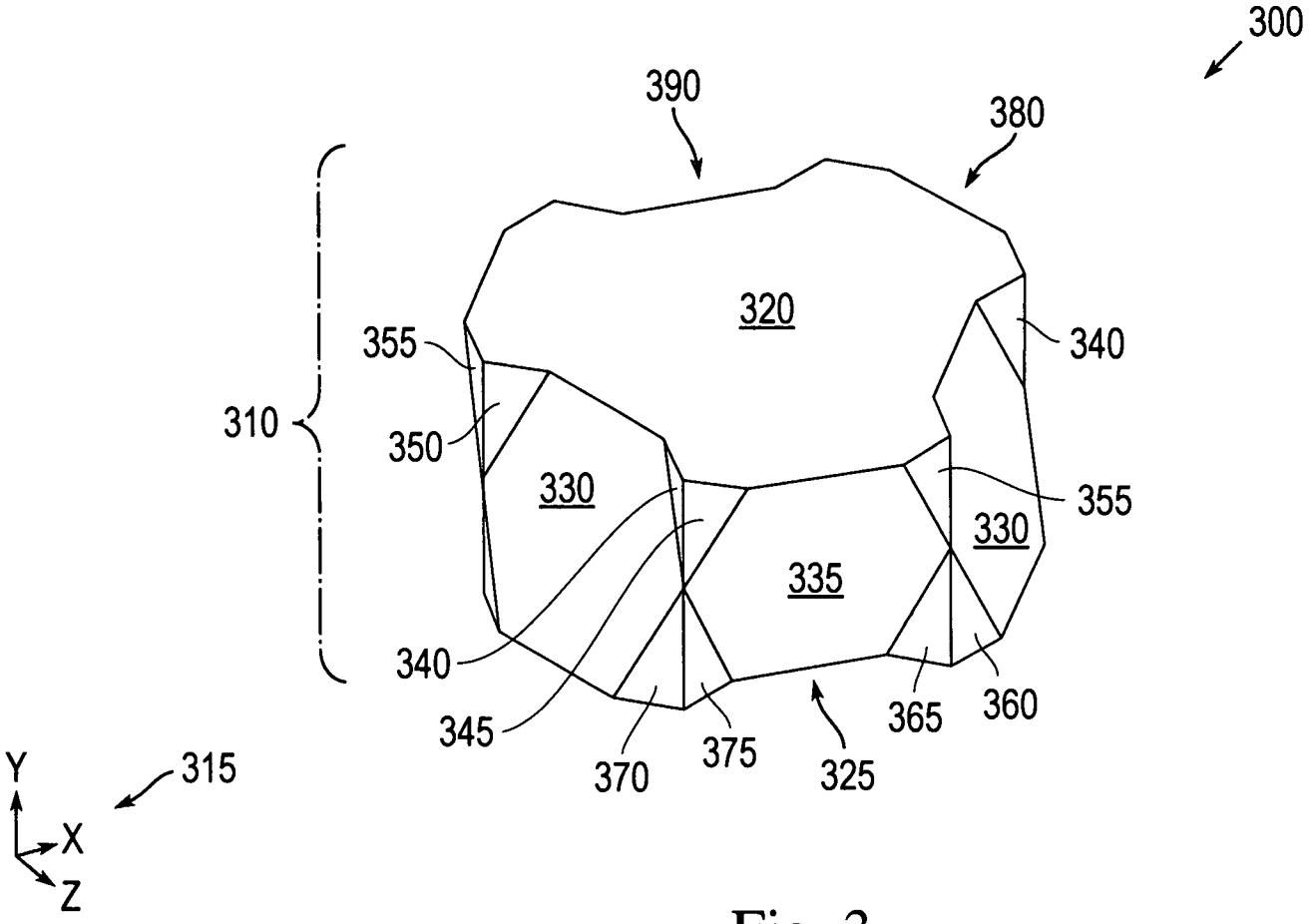
FIG. 3 is an isometric view of a second tile configuration.

FIG. 3 shows an isometric view 300 of a second tile configuration 310 for the AHT. A compass rose 315 shows orientation of the second AHT 310 similarly as rose 115. View 300 shows an obverse planar surface 320 (normal upward relative to y) parallel to a reverse planar surface 325 (normal downward relative to y). These planar surfaces 320 and 325 reveal a contiguous triple elongated-octagon form. Triple upward-facing oblique rectangular wedges 330 concatenate alternatingly with counterpart triple downward-facing oblique rectangular wedges 335.

Obverse-adjacent triangular edge facets 340, 345, 350 and 355 interweave the wedges 330 and 335 with the obverse surface 320. Similarly, reverse-adjacent triangular edge facets 360, 365, 370 and 375 interweave the wedges 330 and 335 with the reverse surface 325. These obverse-adjacent and reverse-adjacent triangular facets are substantially parallel to y, and join at the intersections with their associated wedges 330 and 335. The planar surfaces 320 and 325 feature three outward edges 380 joined at chamfered sides of the facets by three inward edges 390. Effectively, centers of the outward edges 380 and the inward edges 390 yield overlapping triangles that form a Star-of-David on the planar surface 320.

Figure 4:
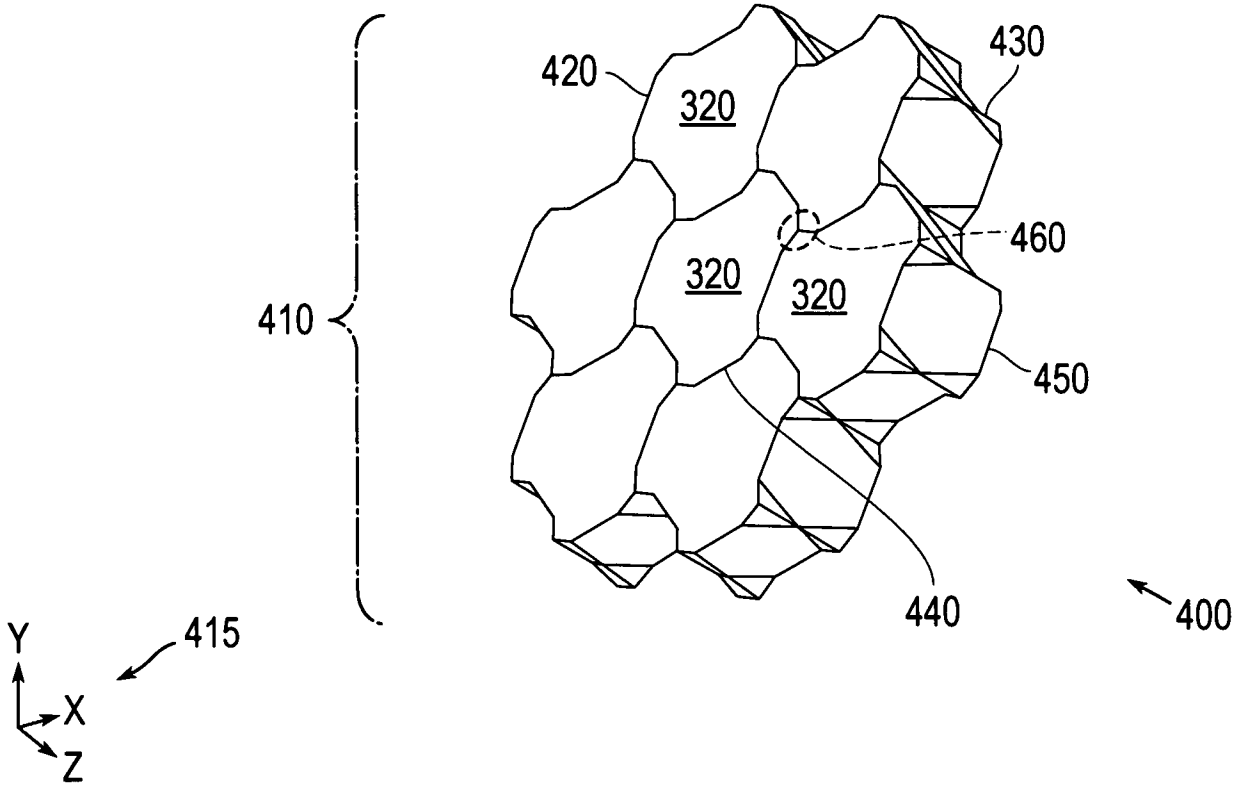
FIG. 4 is an isometric view of an array of second tiles.

FIG. 4 shows an isometric view 400 of an array 410 of the second AHTs 310. A compass rose 415 shows orientation of the assembly 410 with normal to the planar surfaces 320 parallel to the y-direction. The identified tiles 310 include left upper unit 420, right upper unit 430, center unit 440 and right lower unit 450. Edges of units 430, 440 and 450 join together at a junction point 460 between the edges 380 and 390.

Arrays 210 and 410 enable force absorption from kinetic impact onto obverse surfaces 120 and 320 by momentary flexing, coupled with the plastic deformation of individual tiles 110 and 310. In particular, flexing constitutes angular separation of the respective constituent tiles 110 and 310 from their neighbors. For example for view 200, striking the aft unit 230 causes its downward deflection in the –y direction (see rose 115). The adjacent units, including 220, 250 and 260, are constrained laterally by their substrate layers (not shown), and thus deflect by tilting, while maintaining protection against subsequent impacts without serious gaps.

Type of AHT deformation depends on composition material. The AHT can be considered to be a homogeneous substantially isotropic material. Ceramic units, such as boron carbide ($B_4C$) and silicon carbide (SiC), can fracture under high compressive and shear loads. Ceramic material can also include boron carbide derivatives, such as boron carbide nitride, poly(6-cyclooctenyldecaborane) and poly(6-norbornenyldecaborane). Other more ductile materials (e.g., metals) can plastically deform without shattering, but at lower yield strengths than typical for ceramics.

To enable the development of flexible body armor that reduces blunt force trauma from a projectile strike, reduces vulnerabilities from interstitial joints, benefits from decreased weight, and increases multi-hit capability over conventional designs. The force from bullet impact against an angled hexagonal tile matrix is distributed across multiple tiles while still enabling each individual tile to flex. In addition, the angled sides reduce the vulnerabilities of the joining seams, where the angled joints can either deflect or dissipate incident threats.

Based on desire to reduce weight, increase multi-hit capability, and enhance flexibility, the AHT has been designed to satisfy these requirements. The first AHT design modifies geometry relative to the second AHT design, thereby simplifying the production, lowering the cost, and minimizing the number of interface surfaces to improve the transmission of shock waves across each other, instead of the wearer.

The AHT objects can replace the conventional SAPI/ESAPI plates with the ceramic AHTs, forming equivalent surface area coverage but with fewer gaps for improved bodily protection. Preferably, the ceramic materials are composed of either boron carbide or silicon carbide, and can be manufactured to near theoretical maximum density to provide optimal material properties. Alternative ceramics can be used, including compositions that derive from boron carbide.

The ceramic AHT units are joined together in an array and adhered to a spall liner fabric substrate. After adhesion to the liner, the AHTs 110 and/or 310 can optionally be encapsulated within polyurea foam. This technique is described in U.S. Patent Application Publication 2012/0312150, incorporated by reference in its entirety.

The exemplary AHTs can be integrated into the body armor system similar to the current SAPI/ESAPI plates as inserts. For each exemplary first AHT 110, the six peripheral faces 130 and 135 are angularly disposed in relation to the nominal hexagonal orientation, with each AHT 110 having three positively angled wedges 130 and three negatively angled wedges 135 alternating symmetrically back and forth along the periphery.

The adherence of the reverse surface 125 to the spall liner inhibits lateral tile movement. In response to kinetic impact, the AHTs 110 direct force on each neighboring tile through the angled wedges 130 and 135, enabling the impact energy to be distributed across all of the AHTs 110. The angled wedges also reduce the interstitial vulnerability at seams between tiles 110 by eliminating straight-through points. This similarly applies to the second AHT 310.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An angled hexagonal tile (AHT) for incorporating as an interleaving arrayed plurality into a personnel armor clothing article, said plurality being adhered a liner substrate, said AHT comprising:

a hexagonally-symmetric solid object composed of a homogeneous material, said object including a geometry that has:

obverse and reverse planar surfaces parallel to each other and separated by a thickness, each planar surface having triangularly disposed terminals, each obverse terminal being angularly offset to an adjacent reverse terminal, said terminals on each corresponding said planar surface having a length between a vertex at a first terminal and a center-point between second and third terminals;

a first triple set of obverse-facing oblique surfaces disposed between said obverse and reverse planar surfaces, each obverse-facing oblique surface connecting an obverse center-point on said obverse planar surface and a corresponding reverse terminal on said reverse planar surface;

a second triple set of reverse-facing oblique surfaces disposed between said obverse and reverse planar surfaces, each reverse-facing oblique surface connecting an obverse terminal on said obverse planar surface and a corresponding reverse center-point on said reverse planar surface; and a plurality of facets substantially perpendicular to said planar surfaces, said facets connecting between edges of said planar surfaces and adjacent edges of said oblique surfaces, wherein said first and second triple sets of oblique surfaces are disposed to alternate with each other.

2. The AHT according to claim 1, wherein said material is a ceramic.

3. The AHT according to claim 2, wherein said material is boron carbide.

4. The AHT according to claim 2, wherein said material is a boron carbide derivative.

5. The AHT according to claim 2, wherein said material is silicon carbide.

6. The AHT according to claim 1, wherein said terminal is a tip point and said each planar surface forms a contiguous triangular set of regular hexagons.

7. The AHT according to claim 1, wherein said terminal is an outer edge and said each planar surface forms a bounded domain that encompasses a triangular set of elongated octagons.

8. The AHT according to claim 1, wherein said obverse-facing oblique surface interfaces with an opposing reverse-facing oblique surface on a first adjacent AHT in the array, and said reverse-facing oblique surface interfaces with an opposing obverse-facing oblique surface on a second adjacent AHT in the array.

9. The AHT according to claim 1, wherein said length is between one inch and five inches, and said thickness is between ¼ inch and ⅝ inch.

* * * * *